United States Patent [19]

Brisebarre

[11] 4,111,216

[45] Sep. 5, 1978

[54] CENTRIFUGAL COIN SORTER

[75] Inventor: Marcel Brisebarre, Thoiry, France

[73] Assignee: Systems and Technics S.A., Gland, Switzerland

[21] Appl. No.: 771,371

[22] Filed: Feb. 23, 1977

[30] Foreign Application Priority Data

Apr. 1, 1976 [CH] Switzerland ..... 4042/76

[51] Int. Cl.[2] ..... G07D 3/06

[52] U.S. Cl. ..... 133/3 A

[58] Field of Search ..... 133/3 A, 3 R, 3 H

[56] References Cited

U.S. PATENT DOCUMENTS

| | | | |
|---|---|---|---|
| 2,348,936 | 5/1944 | Sprenger | 133/3 R |
| 2,906,276 | 9/1959 | Blanchette et al. | 133/3 R |
| 3,795,252 | 3/1974 | Black | 133/3 A |

*Primary Examiner*—Stanley H. Tollberg
*Attorney, Agent, or Firm*—Young & Thompson

[57] ABSTRACT

The invention relates to a coin sorting machine comprising a rotary plate, a funnel located in the central portion of the plate, a peripheral shoulder which prevents the coins from leaving the rotary plate as well as at least one station for the selection and extraction of one coin denomination from the remaining coin denominations.

This machine is characterized in that each selection station comprises on the one hand structure permitting a movement of at least part of a coin beneath the upper surface of the plate and on the other hand a coin-contacting element which comes into contact with a coin to be selected lying flat on the rotary plate, and pushes the radially inner part of the coin below the upper surface of the plate so that the radially outer part of the coin is tipped up and clears the shoulder and the coin is ejected by centrifugal force over the shoulder, without tumbling.

This machine permits a very rapid sorting of a store of loose coins.

17 Claims, 10 Drawing Figures

CENTRIFUGAL COIN SORTER

The present invention relates to coin sorting machines.

A certain number of coin sorting machines exist, said machines falling into two general categories:

(a) machines which permit the sorting of only a single denomination of coins at once. It is then necessary to introduce the said coins to be sorted successively into the same number of machines as there are denominations to be sorted. This is necessarily very time consuming and it is necessary to have 5 to 8 machines, depending on the national currencies to be sorted. It also takes up a large amount of space and the machines then have to be arranged in cascade.

(b) machines which sort several denominations at once but which have a very limited efficiency because the coins to be sorted must travel by gravity along a previously fixed path.

The object of the present invention is to provide a coin sorting machine which simultaneously permits the sorting of several denominations at high speeds.

The present invention has for its object a coin sorting machine comprising a frame on which is pivoted a rotary plate and means for rotating said plate; a funnel for receiving the coins in loose form located in the central part of said plate; positioning means for the coins permitting the discharge from said funnel of only those coins which are placed flat on the surface of the rotary plate; a peripheral stop preventing the coins from leaving the rotary plate as well as at least one station for the selection and extraction of one denomination of coins from among the others, characterised in that each selection station has on the one hand means carried by the rotary plate permitting a movement of at least part of a coin below the upper surface of the plate and on the other hand a coin-contacting element carried by the frame and entering into contact with a coin to be selected and which is lying flat on the rotary plate.

The attached drawings schematically illustrate in exemplified manner an embodiment of the coin sorting machine according to the present invention.

Figure 1:
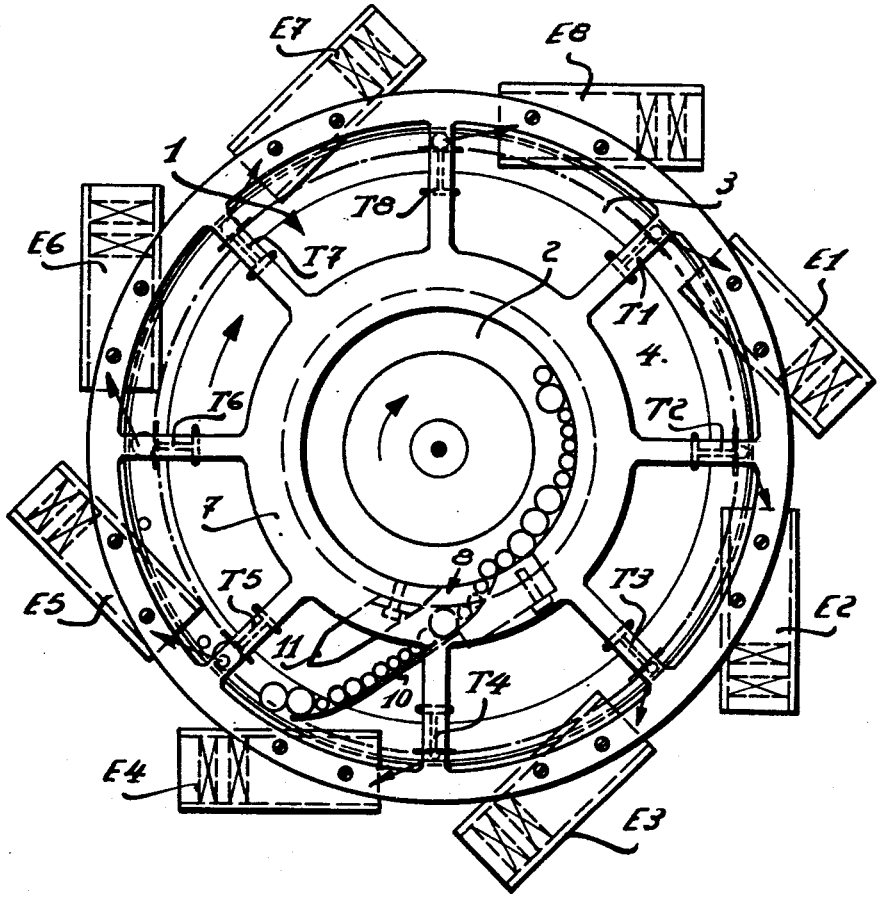
FIG. 1 is a schematic plan view.
Figure 2:
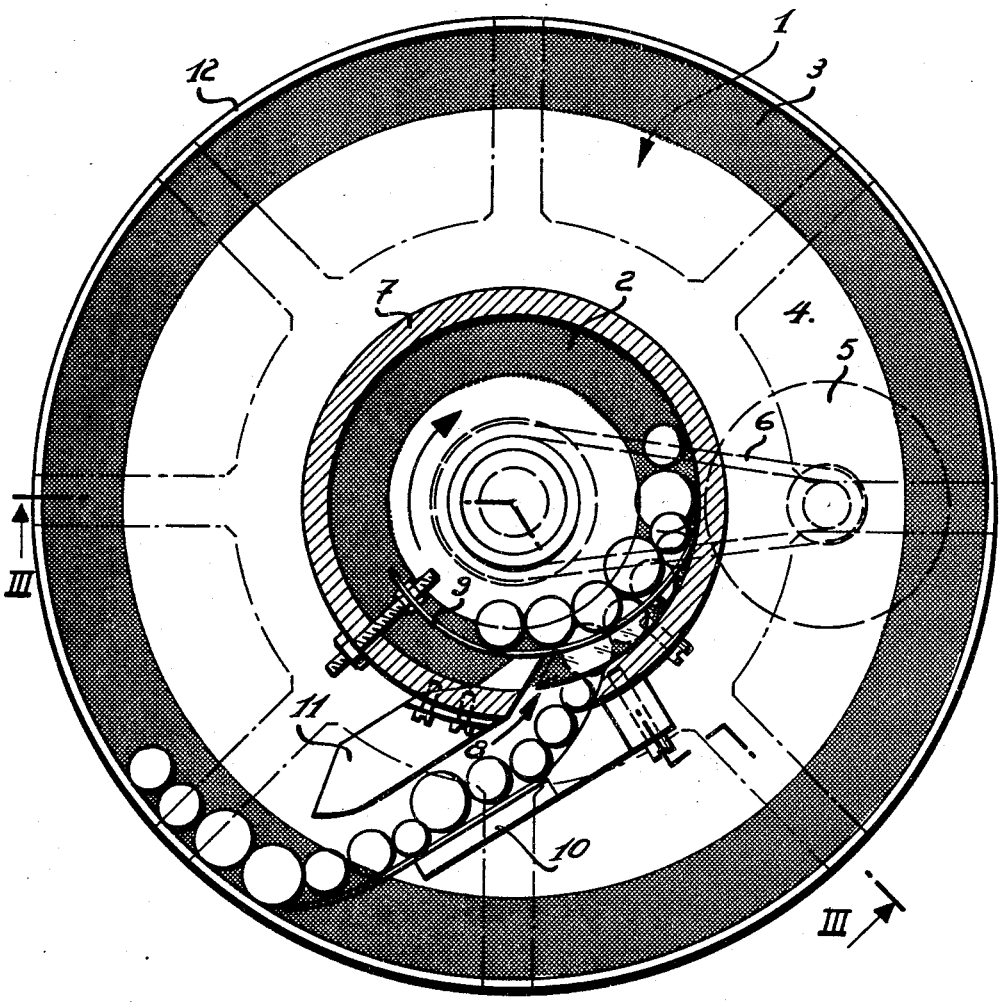
FIG. 2 is a larger scale plan view, with certain parts removed.
Figure 3:
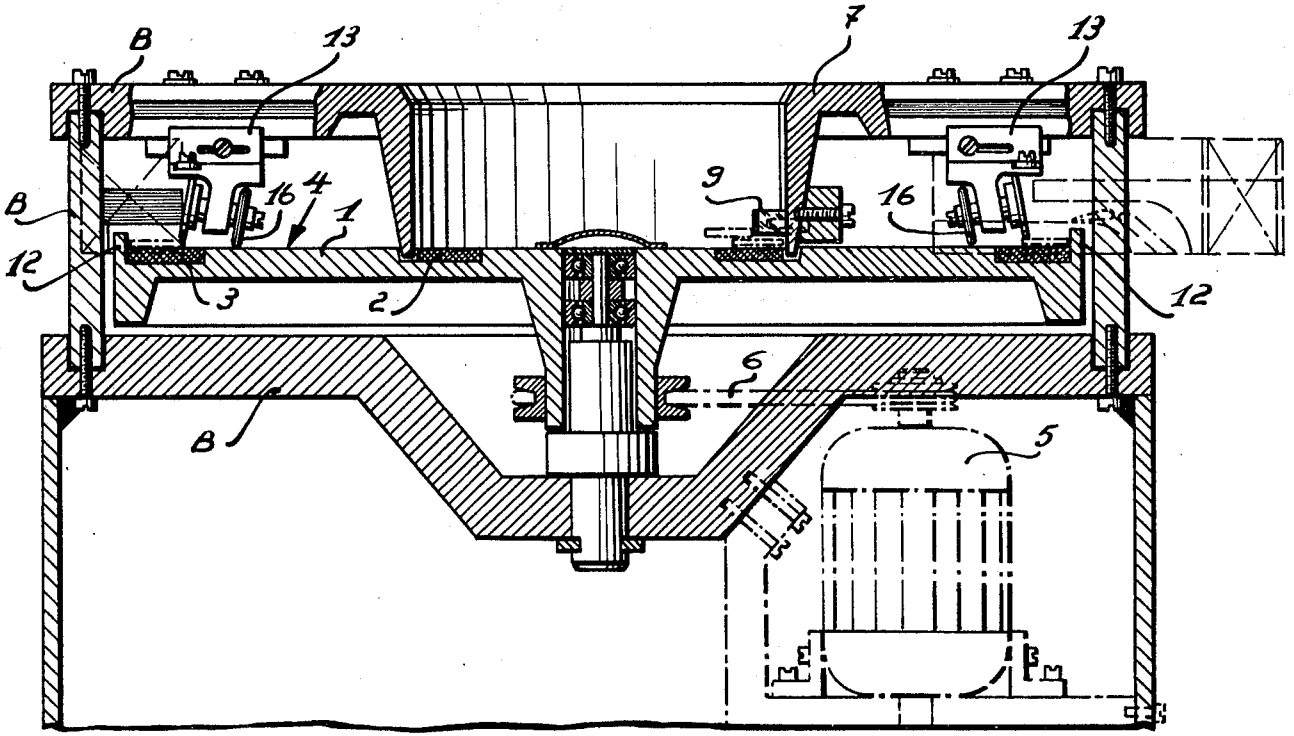
FIG. 3 is a cross-sectional view.
Figure 4:
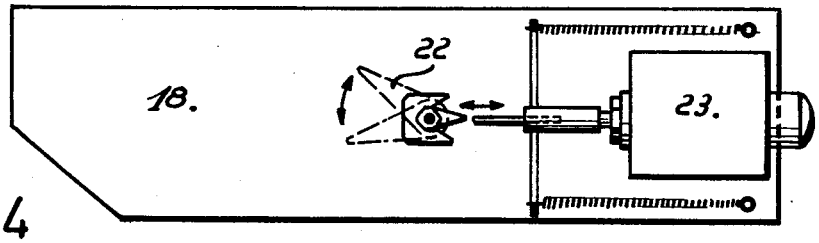
FIG. 4 illustrates the control device for the coin deflector.
Figure 5:
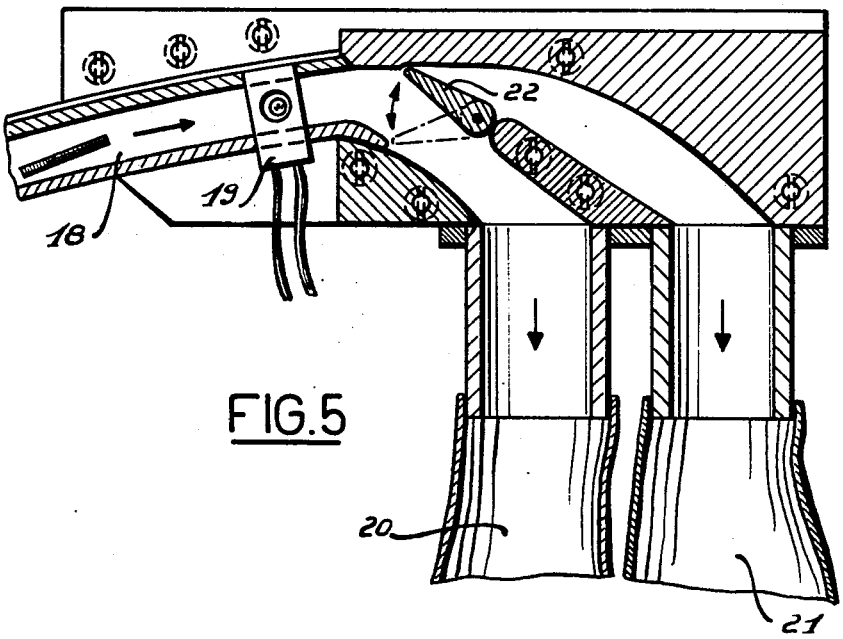
FIG. 5 illustrates a section of the coin deflector.
Figure 6:
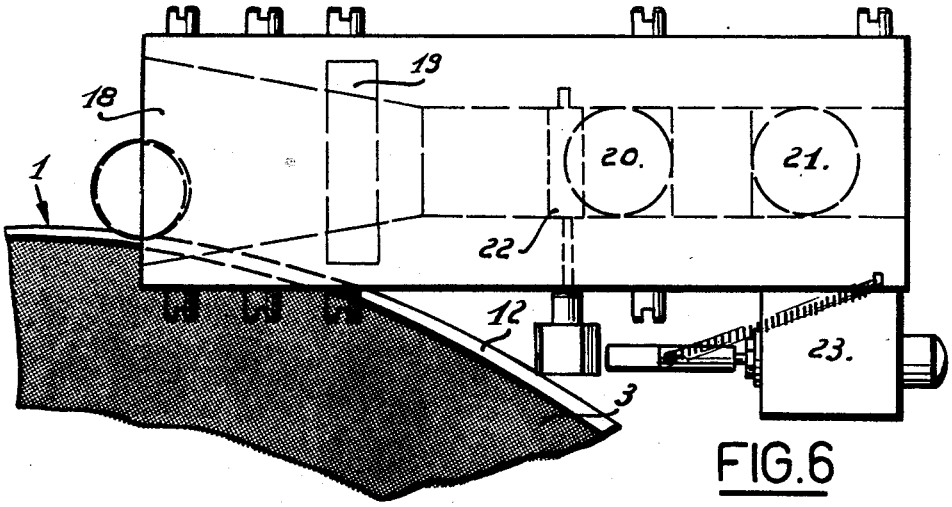
FIG. 6 illustrates in plan view a station for receiving a sorted coin.

The illustrated coin sorting machine comprises a rotary plate 1 having two concentric driving areas 2, 3 with a high coefficient of friction with the coins, separated by a sliding zone 4. The rotary plate is rotated by an electric motor 5 and belt 6.

A cylindrical funnel 7 centred on plate 1 receives the loose coins, whereby all denominations are mixed. The coins are carried along by the high friction area 2 and the centrifugal force imparted thereto by the rotation of the plate tends to displace them radially towards the edge of the plate 1, but are held back by the wall of the funnel.

Over part of its periphery, this funnel has a slot 8 permitting the passage of the coins towards the outside. A strip 9 located inside the funnel prevents two superimposed coins from passing through the slot 8 at the same time.

A channel formed by guides 10, 11 leads the coins which have passed through slot 8 to the periphery of disk 1.

Along guide 10, the coins are accelerated, slide on plate 1 in zone 4 and are separated from one another to abut against the peripheral shoulder 12 of disk 1. At this time, the coins are once again in a driving area 3 and are driven at the speed of plate 1. The driving area 3 is made from an elastic material.

The same number of sorting stations T and extracting stations E as there are coin denominations to be sorted are distributed around the axis of disk 1. These stations are arranged in the rotation direction of disk 1, in accordance with the diameter of the coins which they must sort, whereby the station which sorts the coins with the largest diameter is positioned first.

All the sorting stations T and extraction stations E are similar, so that only one of them will be described in detail.

Each of the sorting stations T has a regulatable support 13 fixed to the frame B of the machine and carries, mounted on springs 26, 27 a movement 15 comprising a drive wheel 16 applied against the surface of the disk 1 and driving a disk 17. The shaft 14 carrying wheel 16 and disk 17 is inclined relative to the plane of plate 1 and disk 17 is located in such a way that its periphery is spaced from the surface of plate 1 by a value which is slightly less than the thickness of the coin of the denomination to be sorted by this station and is spaced from the circular shoulder 12 by a value which is slightly less than the diameter of the denomination of coin to be sorted by this station.

Movement 15 on which is pivoted shaft 14 is guided on support 13 by a pin 24 fixed to support 13 engaged in a countersunk hole 25, having the shape of an arc of a circle, made in movement 15. The radius R and the orientation of this countersunk hole are such that the movement 15 pivots in normal operation counter to the action of spring 26 relative to support 13 at any point of contact between wheel 16 and plate 1. This pivoting movement does not affect the position of disk 17 relative to plate 1 and ensures a good driving of wheel 16, even if its tyre has been irregularly worn.

The outer part of the movement carrying disk 17 is engaged with the support by calibrated safety springs 27. The position of disk 17 is regulated as regards height by screws 28 and radially by means of screws 29.

Figure 7:
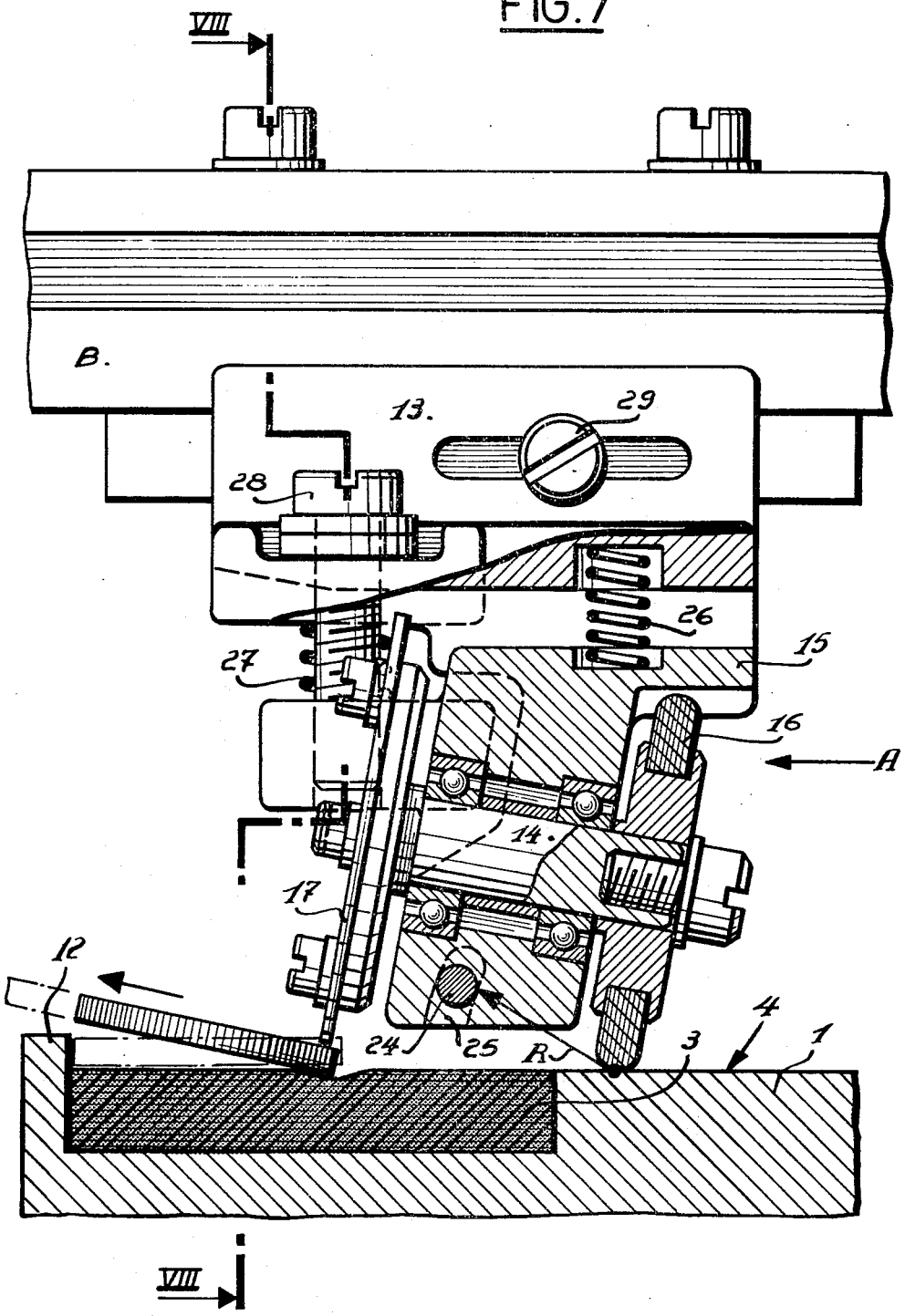
FIG. 7 is a sectional view of a denomination sorting station.

Thus, during rotation, the coins applied against stop 12 pass beneath the first sorting station T1 corresponding to the denomination having the largest diameter. That portion of the coins of this denomination which is directed towards the centre of the plate passes beneath disk 17 causing the inclination of the coin (FIG. 7) by deforming the elastic part 3 of plate 1.

Thus, when disk 17 is applied to this portion of the coin, it leads to a local elastic deformation of area 3 of the disk and the coin pivots about a support point or line close to the action point of disk 17. Thus, the outer edge of the coin is raised, escapes from shoulder 12 and the coin is ejected tangentially beyond the plate by centrifugal force. It should be noted that the thus ejected coin does not turn, but instead remains in its plane. Therefore, not only its trajectory but also its position is stable during the ejection process, so that it can be passed into an extraction channel of relatively small cross-section, thereby alleviating the problems linked with the recovery and in particular the counting of ejected coins.

The coins of other denominations, whose diameters are smaller are not affected by the first sorting station $T_1$.

Thus, the coins are sorted denomination by denomination starting with the coins having the largest diameter and ending with the coins having the smallest diameter. The number of sorting stations T corresponds to the number of denominations in the currency in question.

Figure 8:
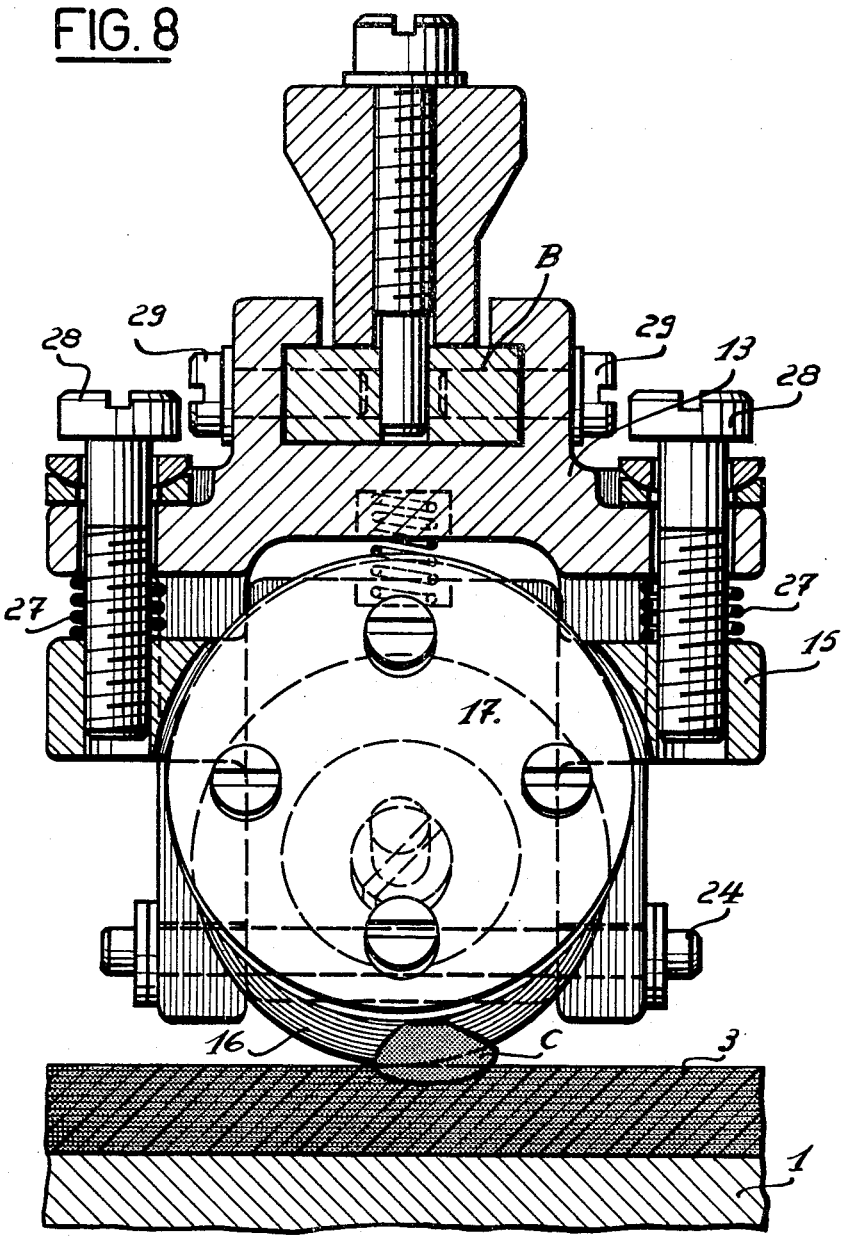
FIG. 8 is an end view in accordance with arrow A of the sorting station of FIG. 7.

As the movement 15 is mounted on safety springs 27, the sorting station is not damaged if a foreign body C passes beneath disk 17 (FIG. 8).

The coin which has been raised and has thus escaped from the circular shoulder 12 enters a corresponding extraction station E. Each of the extraction stations has a recovery channel 18 for the coins ejected from plate 1 comprising a coin detector 19 supplying a counter. Channel 18 supplies two stores 20, 21 for the ejected coins, whereby the supply of one or other of these stores is brought about by the position of a deflecting flap 22 operated by an electromagnet 23 controlled by the counter supplied by detector 19.

Thus, as soon as a predetermined number of coins has been supplied to store 20, the counter controls the displacement of flap 22 which brings about the filling of store 21. Store 20, for example a bag, can be removed by an employee and replaced by an empty bag.

This machine has the following main advantages:

1. It is very compact because it comprises a desired number of sorting stations, which are concentric to the introduction funnel for the loose coins.
2. It is of simple construction, whereby only a single rotary plate is necessary. Furthermore, as the position of the ejected coins is stable, it is possible to detect them by means of a conventional simple sensor.
3. It operates at high speed because the coins can be accelerated said acceleration depending on the rotation speed of the plate.
4. It permits the filling of a store with a given quantity of coins. Thus, the coins are not only sorted but they are also counted. Sorting is not stopped when a store is full and instead a switchover occurs from one stock to the other.

Obviously, in simpler variants of the machine, the rotary disk 17 could be loosely pivoted on movement 15 making it possible to eliminate drive wheel 16.

In a further variant, disk 17 and optionally movement 15 could be replaced by a push button or rod fixed in a rigid but adjustable manner to the frame B of the machine.

In other variants, the elastic peripheral area 3 of the plate can be replaced by circular grooves. In a first variant illustrated in FIG. 9, the plate 1 has a single groove 30. The external diameter R2 of said groove 30 is still larger than a value equal to the diameter R of the shoulder 12, less the diameter of the smallest coin to be sorted, but smaller than the diameter R of shoulder 12, less half the diameter of the largest coin to be sorted. This ensures that all the coins to be sorted pass above groove 30 when they are supported against shoulder 12, but in this position they all have their centre of gravity above the flat peripheral area 3 of disk 1.

Figure 10:
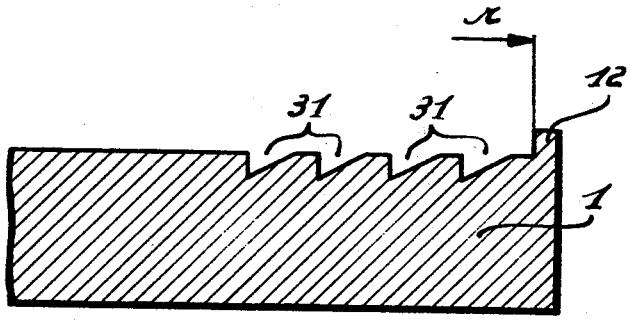
FIG. 10 illustrates in part sectional form a plate provided with a circular groove for each denomination to be sorted.

In the second variant illustrated in FIG. 10, the plate 1 has the same number of grooves 31 as there are denominations to be sorted. The external diameter of groove 31 is larger than the diameter R of shoulder 12, less the diameter of the corresponding coin denomination whilst the internal diameter of each groove 31 is smaller than this value, but still larger than the external diameter of the adjacent groove towards the centre of the plate.

Figure 9:
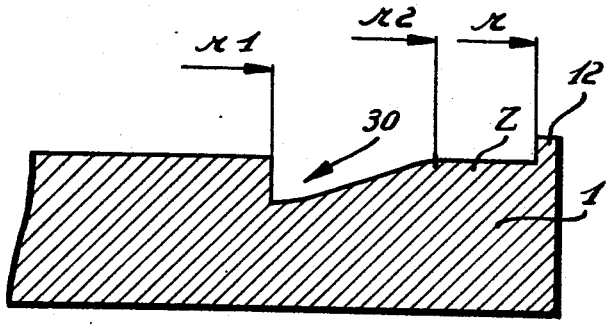
FIG. 9 illustrates in part sectional form a plate having a circular groove.

With plates as illustrated in FIGS. 9 and 10, the coins are extracted as described hereinbefore, whereby the portion of the coins which comes into contact with the push button or rod or disk 17 is introduced into groove 30, 31 and the coin is inclined in such a way that its outer edge escapes from shoulder 12.

Obviously, various modifications can be made by the skilled expert to the device described hereinbefore with reference to a non-limitative embodiment without passing beyond the scope of the invention.

I claim:

1. In a coin sorting machine comprising a frame on which is pivoted a rotary plate and means for rotating said plate; a funnel for receiving the coins in loose form located in the central part of said plate; positioning means for the coins permitting the discharge from said funnel of only those coins which are placed flat on the surface of the rotary plate; a peripheral shoulder preventing the coins from leaving the rotary plate as well as at least one station for the selection and extraction of one denomination of coins from among the others; the improvement in which each selection station has on the one hand means carried by the rotary plate permitting a movement of at least a radially inner part of a coin below the upper surface of the plate and on the other hand coin-contacting means carried by the frame and entering into contact with said radially inner part of a coin to be selected and which is lying flat on the rotary plate to push said radially inner part of the coin below the upper surface of the plate and to raise the radially outer part of the coin higher than said shoulder to eject the coin by centrifugal force over said shoulder.

2. Machine according to claim 1, characterised in that the said means carried by the rotary plate comprise at least one circular groove whose depth increases in the direction of the centre of the plate.

3. Machine according to claim 2, characterised in that the plate has the same number of circular grooves as there are denominations to be sorted.

4. Machine according to claim 2, characterised in that the internal diameter of the groove is smaller than the diameter on which is located the plate shoulder, less the diameter of the smallest coin to be sorted.

5. Machine according to claim 4, characterised in that the external diameter of the groove is larger than the diameter on whch is located the plate shoulder, less the diameter of the smallest coin to be sorted.

6. Machine according to claim 3, characterised in that each groove is located to the right of that portion of the periphery, turned towards the centre of the plate, of the coin whose denominaton corresponds to said groove when said coin is lying flat on the plate and is applied against the peripheral shoulder.

7. Machine according to claim 1, characterised in that the said means comprise a peripheral annular area made from a flexible elastic material.

8. Machine according to claim 1, characterised in that the coin-contacting means is placed on the trajectory of the inner edge of a coin of corrseponding denomination supported against the plate shoulder at a distance from the plate which is less than the thickness of the coin of the envisaged denomination.

9. Machine according to claim 8, characterised in that the coin-contacting means is a fixed member.

10. Machine according to claim 8, characterisd in that the coin-contacting means is a rotary member.

11. Machine according to claim 1, characterised in that between the central funnel and the peripheral area of the plate, the later has a sliding zone, whereby the coins traverse the latter under the action of centrifugal force and are accelerated and separated from one another.

12. Machine according to any one of the claim 1, characterised in that each selection station has a disk mounted in pivotal manner on the frame of the machine rotated by a roller in contact with the rotary plate.

13. Machine according to claim 12, characterised in that the face of the disk is located at a distance from the rotary plate which is less than the thickness of the coin denomination corresponding to the selection station.

14. Machine according to claim 13, characterised in that the periphery of the disk located in the vicinity of the plate is spaced from the peripheral shoulder by a distance less than the diameter of the coin denomination to be sorted, but greater than the diameter of all the other coins of smaller diameters than the denomination to be sorted.

15. Machine according to claim 14, characterised in that the disk and its drive wheels are pivoted in a movement mounted on a support, said movement being displaceable relative to the support counter to the action of springs.

16. Machine according to claim 14, characterisd in that each sorting station is followed by an extraction station having a channel for receiving the ejected coins, a detector for said coins and two stores for said ejected coins.

17. Machine according to claim 16, characterised in that each extraction station has a flap controlled by a counter supplied by the detector which directs the coins to one or other of the stores.

* * * * *